US006546975B1

(12) United States Patent
Liao et al.

(10) Patent No.: US 6,546,975 B1
(45) Date of Patent: Apr. 15, 2003

(54) WOOD PLANING MACHINE WITH A CARRIAGE HEIGHT ADJUSTING UNIT

(76) Inventors: Juei-Seng Liao, No. 295, Sec. 1, Nanking E. Rd., Taichung City (TW); Pei-Lieh Chiang, No. 12, Nan-Ping Rd., Nan Dist., Taichung City (TW)

( * ) Notice: Subject to any disclaimer, the term of this patent is extended or adjusted under 35 U.S.C. 154(b) by 0 days.

(21) Appl. No.: 10/163,225

(22) Filed: Jun. 5, 2002

(30) Foreign Application Priority Data

Apr. 11, 2002 (TW) ..... 91204748 U

(51) Int. Cl.[7] ..... B27C 1/00

(52) U.S. Cl. ..... 144/130; 74/22 A; 74/27; 144/117.1

(58) Field of Search ..... 409/210, 218; 74/22 A, 27, 89.28, 473.14, 473.23, 473.3; 451/9, 296; 144/114.1, 116, 117.1, 129, 130

(56) References Cited

U.S. PATENT DOCUMENTS 5,829,499 A 11/1998 Liao
6,415,829 B1 * 7/2002 Chiang ..... 144/130
6,427,737 B1 * 8/2002 Chiang ..... 144/138
2002/0074061 A1 * 6/2002 Chiang ..... 144/130

* cited by examiner

*Primary Examiner*—W. Donald Bray
(74) *Attorney, Agent, or Firm*—Christie, Parker & Hale, LLP

(57) ABSTRACT

A wood planing machine includes a base, posts extending upright from the base, a cutter carriage mounted slidably on the posts, a pair of screw rods associated with the cutter carriage, a motor with an output shaft, and a carriage height adjusting unit that includes a driving shaft mounted rotatably on the cutter carriage, a sliding member slidably mounted on the driving shaft, first and second shaft-driving gears mounted rotatably on opposite ends of the sliding member, a driving gear connected to the output shaft and disposed between the first and second shaft-driving gears, and a gear mechanism coupled to the driving shaft and the screw rods. The sliding member is movable between an upward position, in which, the driving gear engages the first shaft-driving gear, and a downward position, in which the driving gear engages the second shaft-driving gear.

4 Claims, 11 Drawing Sheets

WOOD PLANING MACHINE WITH A CARRIAGE HEIGHT ADJUSTING UNIT

CROSS-REFERENCE TO RELATED APPLICATION

This application claims priority of Taiwan patent Application No. 91204748, filed on Apr. 11, 2002.

BACKGROUND OF THE INVENTION

1. Field of the Invention

This invention relates to a wood planing machine, more particularly to a wood planing machine with a carriage height adjusting unit driven by a motor.

2. Description of the Related Art

U.S. Pat. No. 5,829,499 discloses a wood planing machine that includes pillars and threaded rods extending upright from a bed, and an upper housing slidably mounted on the pillars and the threaded rods. A transmission gear and a coupling rod are coupled to the threaded rods and the upper housing so as to permit sliding movement of the upper housing along the pillars.

The aforesaid wood planing machine is disadvantageous in that sliding movement of the upper housing is manually operated via a handle. Operation as such is laborious.

SUMMARY OF THE INVENTION

Therefore, it is an object of the present invention to provide a wood planing machine with a carriage height adjusting unit that is driven by a motor so as to permit automated adjustment of the height of a cutter carriage of the wood planing machine.

Accordingly, a wood planing machine of this invention comprises: a base having left and right sides; left and right pairs of parallel posts extending upright from the left and right sides of the base, respectively; left and right screw rods extending upright from the left and right sides of the base between the left and right pairs of the posts, respectively, and parallel to the posts; a cutter carriage extending among the posts and having left and right mounting seats that are slidably sleeved on the posts and that have left and right outer walls, respectively, the left outer wall being formed with an opening; a motor mounted on the cutter carriage and having an output shaft that extends outwardly through the opening in the left outer wall; a bracket secured to the left outer wall; and a carriage height adjusting unit.

The carriage height adjusting unit includes: a driving shaft mounted rotatably on the bracket; a sliding member having opposite front and rear ends that are slidably sleeved on the driving shaft so as to permit sliding movement of the silding member along the driving shaft; opposing first and second shaft-driving gears slidably sleeved on and engaging the driving shaft so as to co-rotate with the driving shaft, and mounted on the front and rear ends of the sliding member, respectively, so as to slide with the sliding member along the driving shaft; a driving gear coaxially and securely connected to the output shaft and disposed between the first and second shaft-driving gears; a first gear mechanism operably coupled to the sliding member in such a manner that operation of the first gear mechanism via an external force applied thereto results in sliding movement of the sliding member together with the first and second shaft-driving gears along the driving shaft from a middle position, in which, the driving gear disengages from the first and second shaft-driving gears, to an upward position, in which, the first shaft-driving gear engages the driving gear so as to permit rotation of the driving shaft in a first direction upon actuation of the motor, and from the middle position to a downward position, in which, the second shaft-driving gear engages the driving gear so as to permit rotation of the driving shaft in a second direction that is opposite to the first direction upon actuation of the motor; and a second gear mechanism coupled to the driving shaft and the left and right screw rods so as to permit upward and downward movements of the cutter carriage along the posts upon rotation of the driving shaft in the first and second directions, respectively.

BRIEF DESCRIPTION OF THE DRAWINGS

In drawings which illustrate an embodiment of the invention.

DETAILED DESCRIPTION OF THE PREFERRED EMBODIMENT

Figure 1:
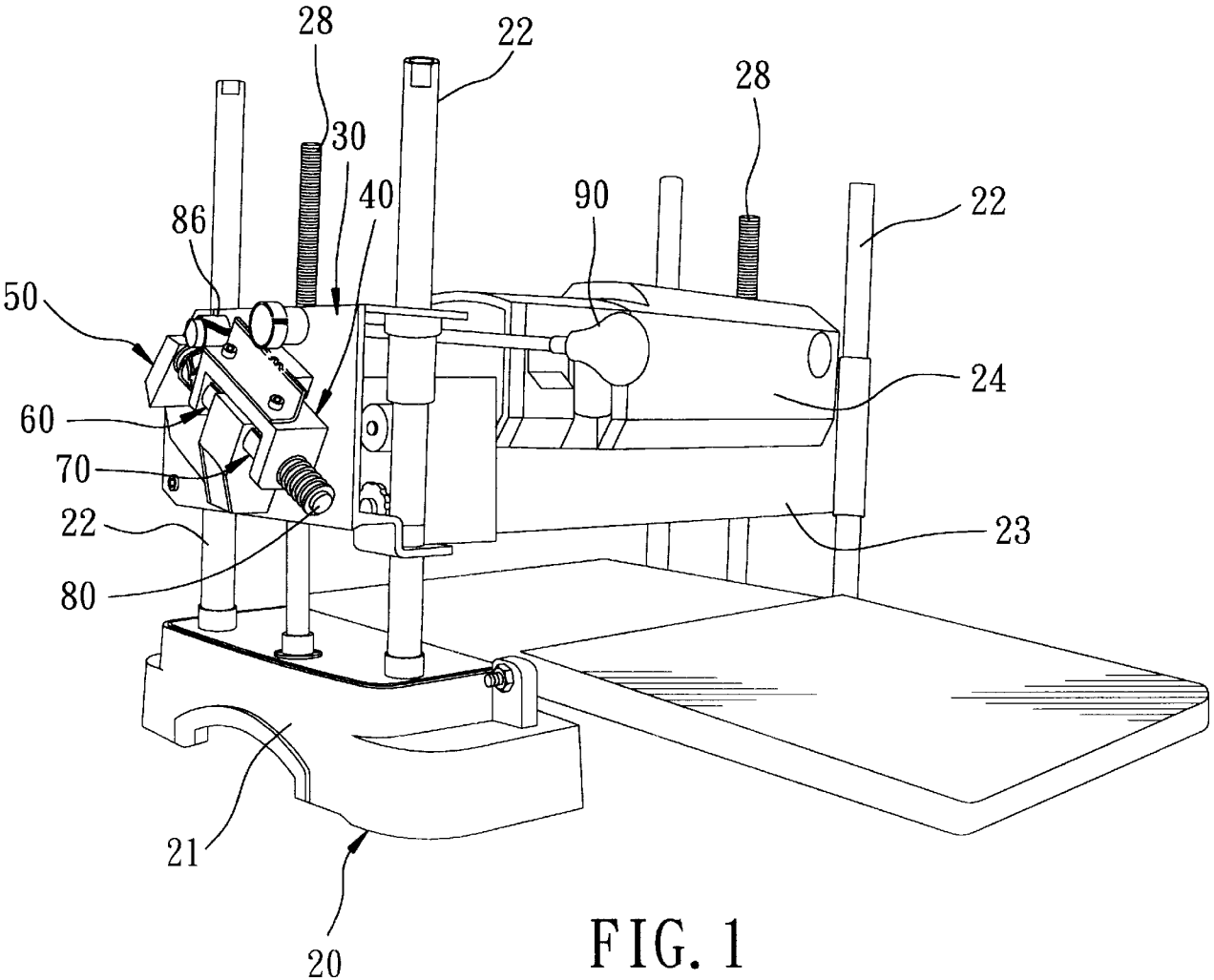
FIG. 1 is a perspective view of a wood planing machine embodying this invention.
Figure 2:
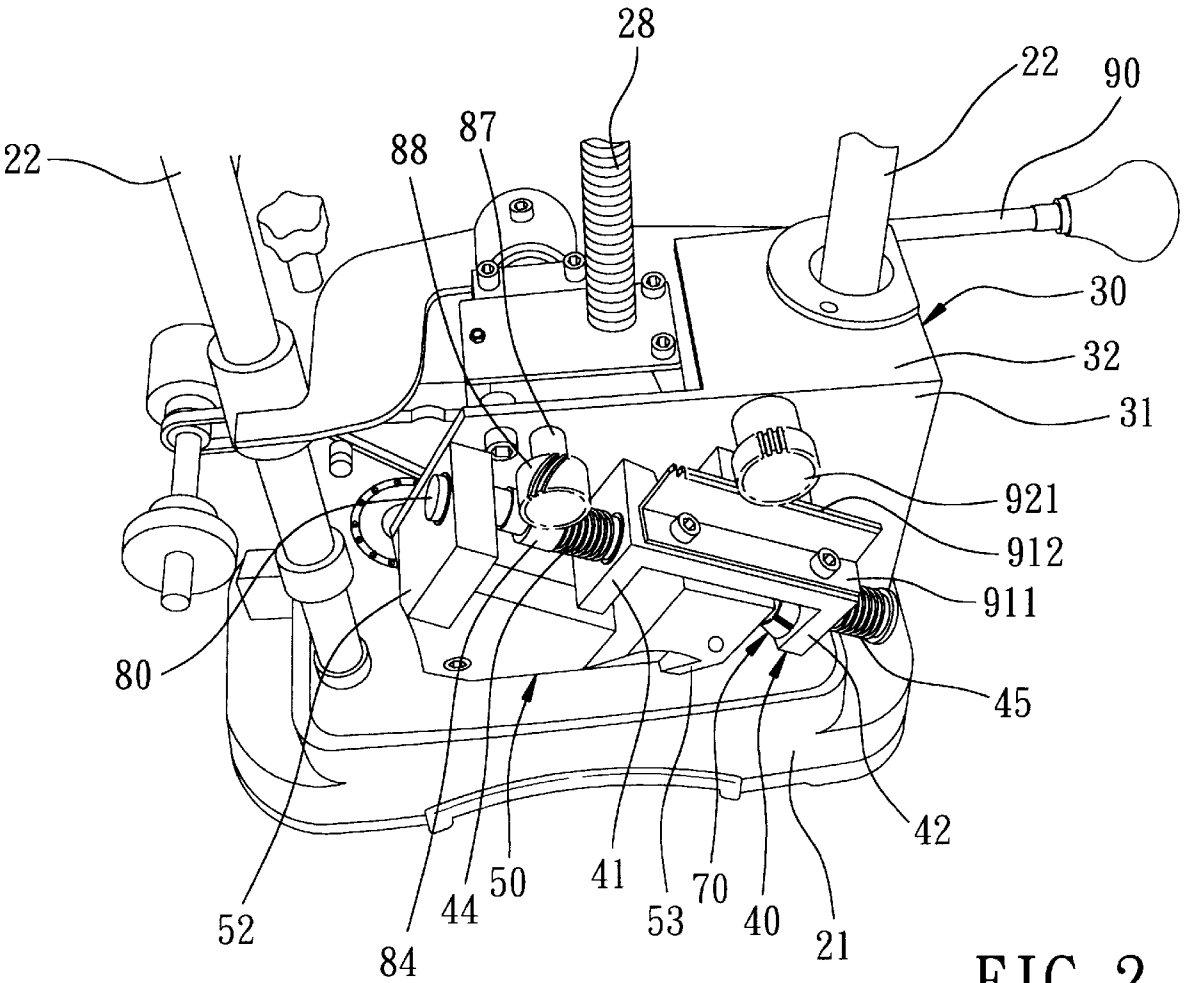
FIG. 2 is a fragmentary perspective view illustrating a carriage height adjusting unit of the wood planing machine of FIG. 1.

FIGS. 1 to 5 illustrate a wood planing machine embodying this invention. The wood planing machine includes: a base 20 having left and right sides 21; left and right pairs of parallel posts 22 extending upright from the left and right sides 21 of the base 20, respectively; left and right screw rods 28 extending upright from the left and right sides 21 of the base 20 between the left and-right pairs of the posts 22, respectively, and parallel to the posts 22; a cutter carriage 23 extending among the posts 22 and having left and right mounting seats 30 that are slidably sleeved on the posts 22 and that have left and right outer walls 31, respectively, the left outer wall 31 being formed with an opening 311; a motor 24 mounted on the cutter carriage 23 and having an output shaft 10 that extends outwardly through the opening 311 in the left outer wall 31; a bracket 50 secured to the left outer wall 31; and a carriage height adjusting unit.

Figure 6:
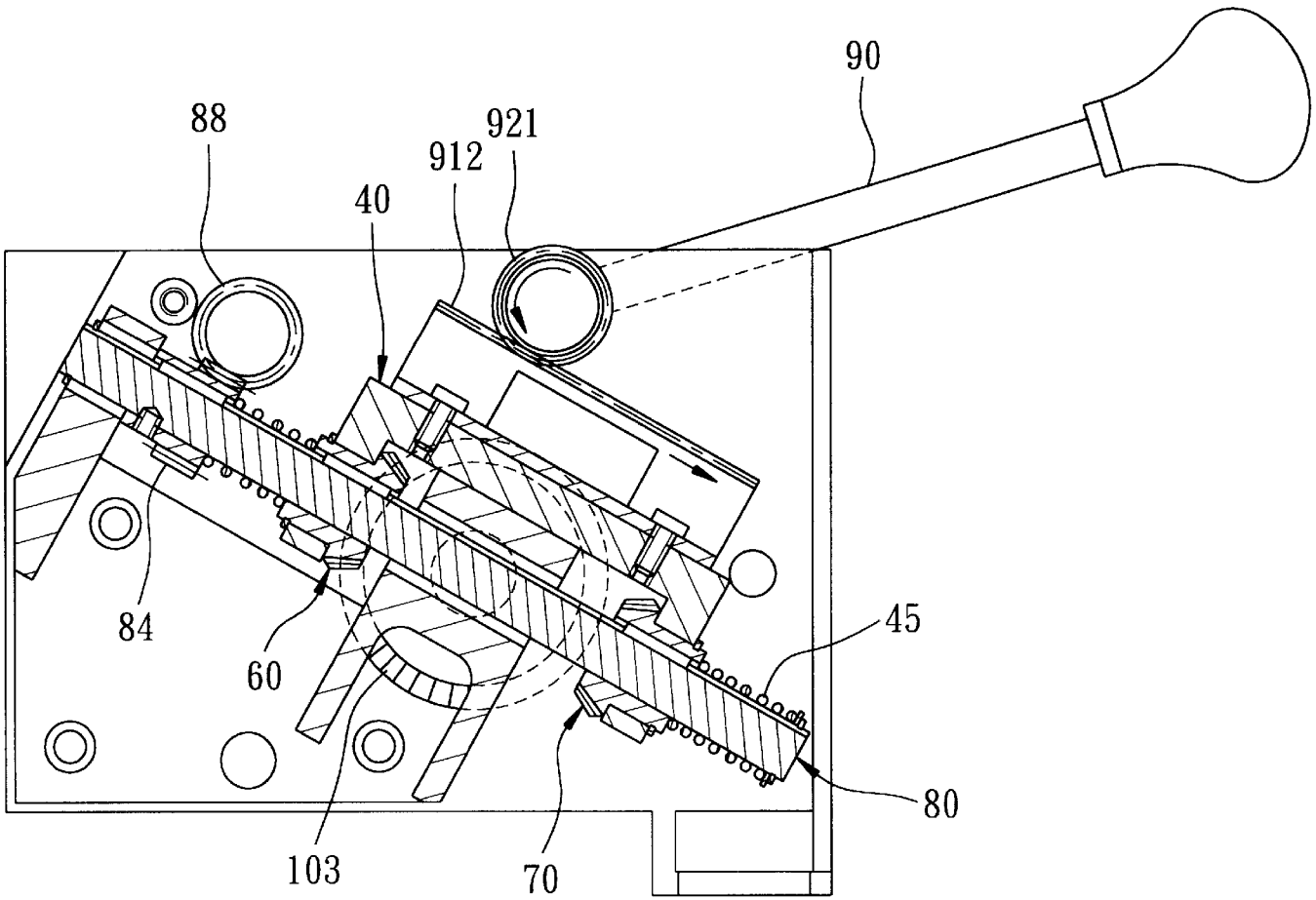
FIGS. 6 and 7 are sectional views illustrating relative positions among the driving gear and the first and second shaft-driving gears of FIG. 4 when the sliding member is disposed at a downward position.
Figure 7:
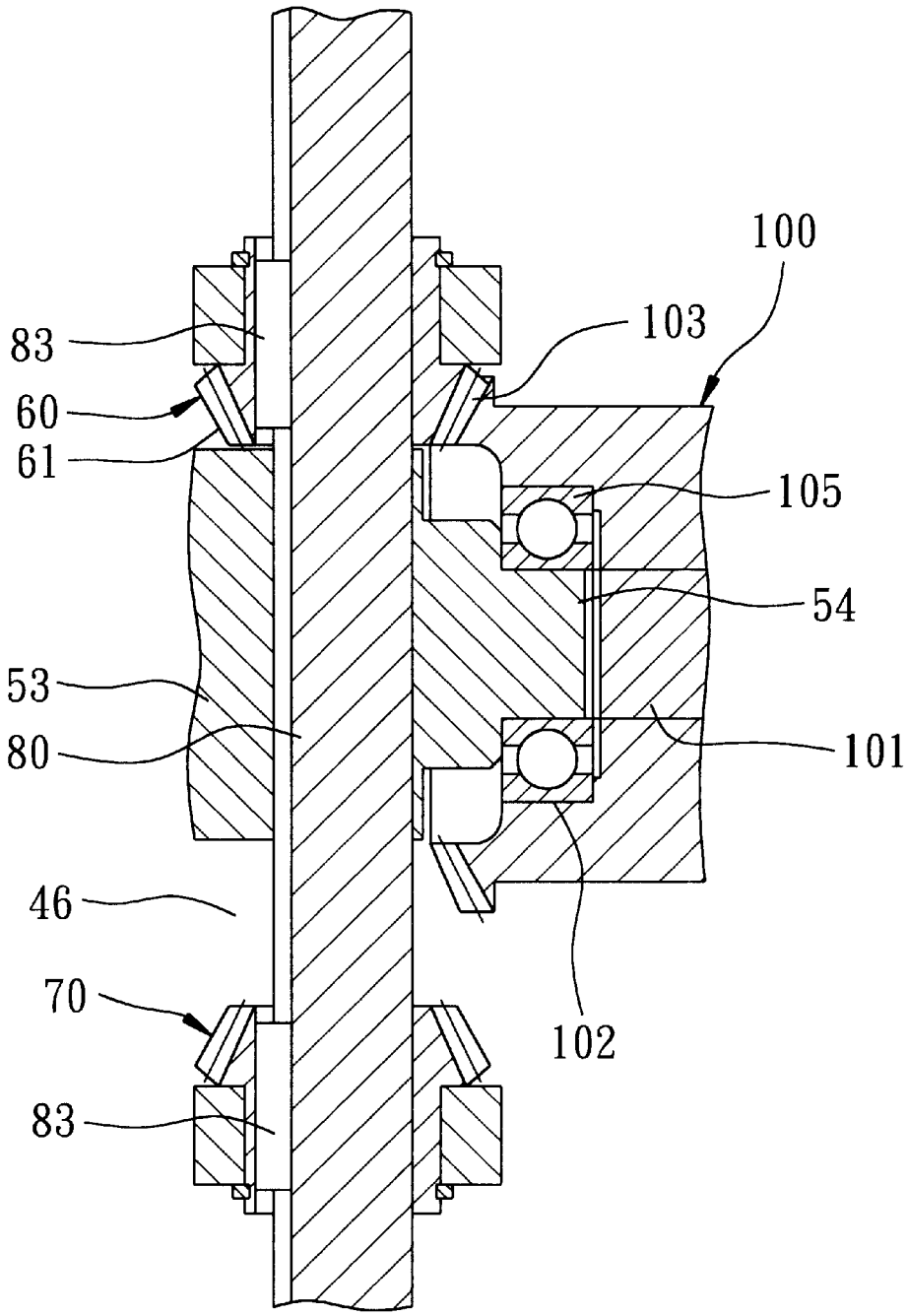
Figure 8:
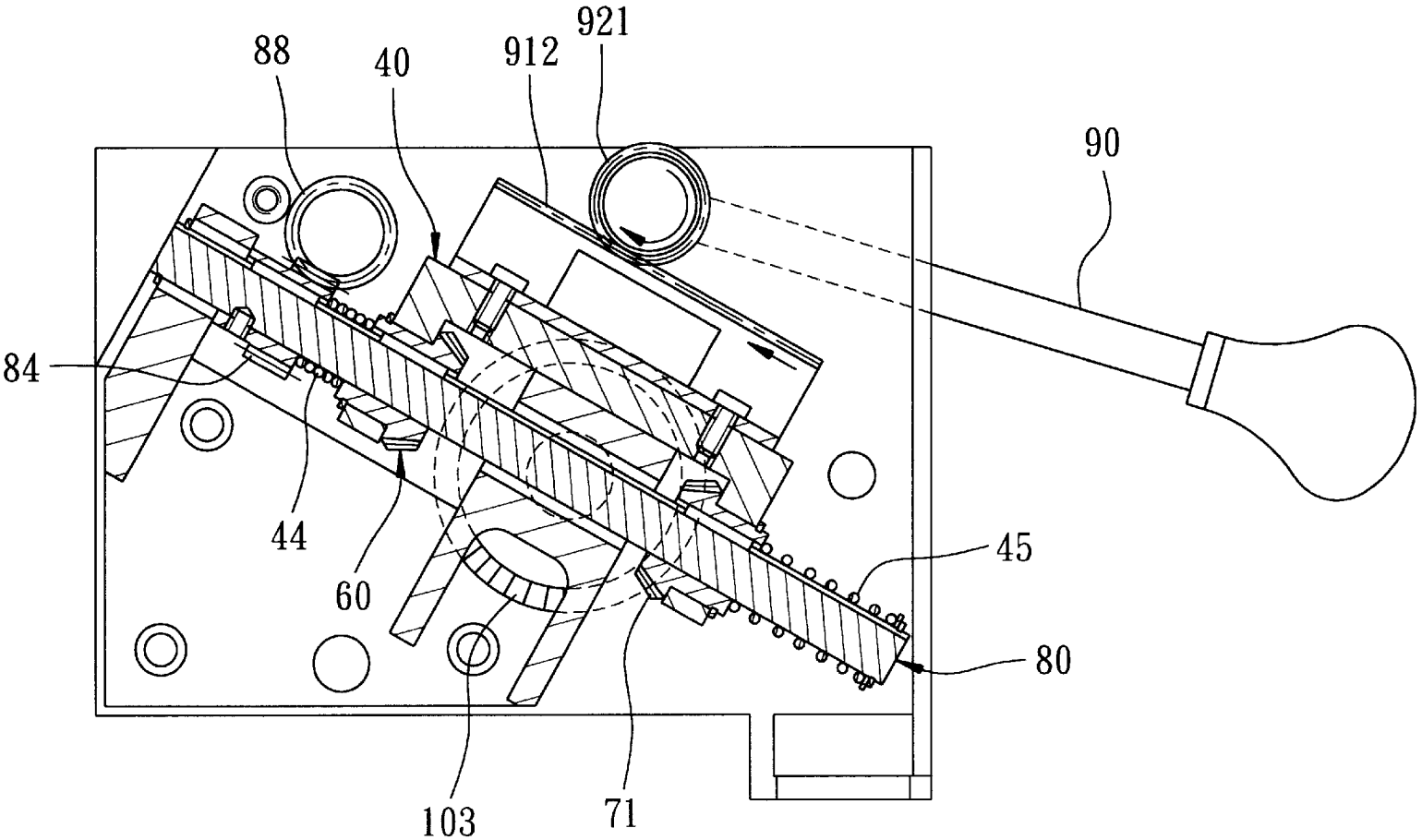
FIGS. 8 and 9 are sectional views illustrating relative positions among the driving gear and the first and second shaft-driving gears of FIG. 4 when the sliding member is disposed at an upward position.
Figure 9:
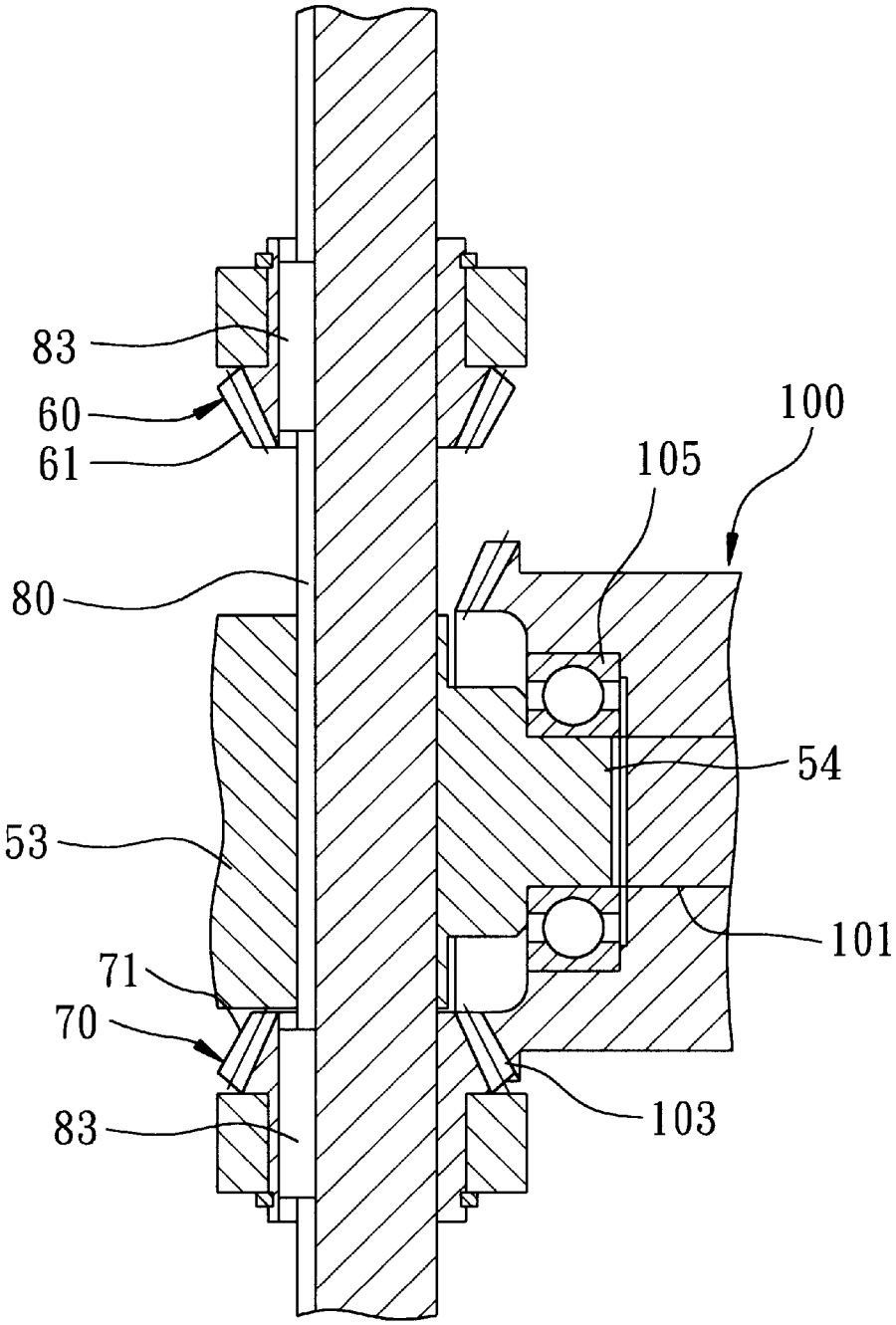

The carriage height adjusting unit includes: a driving shaft 80 mounted rotatably on the bracket 50; a sliding member 40 having opposite front and rear ends 41, 42 that are slidably sleeved on the driving shaft 80 so as to permit sliding movement of the silding member 40 along the driving shaft 80; opposing first and second shaft-driving gears 60, 70 slidably sleeved on and engaging the driving shaft 80 via a pair of wedges 83 so as to co-rotate with the driving shaft 80, and mounted on the front and rear ends 41, 42 of the sliding member 40, respectively, so as to slide with the sliding member 40 along the driving shaft 80; a driving gear 100 coaxially and securely connected to the output shaft 10 and disposed between the first and second shaft-driving gears 60, 70; a first gear mechanism operably associated with the sliding member 40 and including a pinion 921 that is rotatably mounted on the left outer wall 31, and a rack 912 that is secured to the sliding member 40 and that engages the pinion 921 in such a manner that rotation of the pinion 921 via an external force applied thereto results in sliding movement of the sliding member 40 together with the first and second shaft-driving gears 60, 70 along the driving shaft 80 from a middle position (see FIGS. 4 and 5), in which, the driving gear 100 disengages from the first and second shaft-driving gears 60, 70, to an upward position (see FIGS. 6 and 7), in which, the first shaft-driving gear 60 engages the driving gear 100 so as to permit rotation of the driving shaft 80 in a first direction upon actuation of the motor 24, and from the middle position to a downward position (see FIGS. 8 and 9), in which, the second shaft-driving gear 70 engages the driving gear 100 so as to permit rotation of the driving shaft 80 in a second direction that is opposite to the first direction upon actuation of the motor 24; and a second gear mechanism coupled to the driving shaft 80 and the left and right screw rods 28 so as to permit upward and downward movements of the cutter carriage 23 along the posts 22 upon rotation of the driving shaft 80 in the first and second directions, respectively.

The front and rear ends 41, 42 of the sliding member 40 cooperately define a gear-receiving space 46 therebetween for receiving and protecting the first and second shaft-driving gears 60, 70 and the driving gear 100 from undesired intrusion of objects. The bracket 50 has opposite front and rear ends 52, 53. The rear end 53 of the bracket 50 is disposed in the gear-receiving space 46 so as to cover the driving gear 100 for enhancing protection of the driving gear 100.

The driving shaft 80 has opposite front and rear ends 821, 822 that extend through the front ends 41, 52 of the sliding member 40 and the bracket 50 and the rear ends 42, 53 of the sliding member 40 and the bracket 50, respectively. The second gear mechanism includes a first helical gear 84 sleeved securely on the driving shaft 80 between the front ends 41, 52 of the sliding member 40 and the bracket 50. A restoring unit includes an annular abutting plate 81 sleeved on the rear end 822 of the driving shaft 80, a C-shaped ring 89 sleeved on the rear end 822 of the driving shaft 80 and disposed rearwardly of the annular abutting plate 81 to prevent removal of the annular abutting plate 81 from the driving shaft 80, a first coil spring 44 sleeved around the driving shaft 80 and abutting against the first helical gear 84 and the front end 41 of the sliding member 40, and a second coil spring 45 sleeved around the driving shaft 80 and abutting against the rear end 42 of the sliding member 40 and the annular abutting plate 81 so as to permit restoring of the sliding member 40 from the upward and downward positions to the middle position by virtue of urging action of the first and second coil springs 44, 45 when the pinion 921 is relieved from the external force.

The driving gear 100 has a toothed head 103 that defines an inner space 102. A bearing 105 is fittingly received in the inner space 102. The bracket 50 is formed with a stud 54 that projects from the rear end 53 of the bracket 50 and that is received in the bearing 105 so as to enhance stability during rotation of the output shaft 10.

The sliding member 40 further includes an intermediate portion 43 extending between the front and rear ends 41, 42 of the sliding member 40. An L-shaped rack mounting plate 911 is secured to the intermediate portion 43 of the sliding member 40 via screw means 94, and has a top end formed with the rack 912. The left mounting seat 30 further has upper and lower casts 32, 33 that project from top and bottom ends of the left outer wall 31 in a transverse direction relative to the left outer wall 31 and that are formed with holes for passage of a respective one of the posts 22. A mounting tab 321 extends downwardly from one end of the upper cast 32 opposite to the left outer wall 31. The first gear mechanism further includes a coupling rod 92 that is connected to and that extends from the pinion 921 through the left outer wall 31 and the mounting tab 321 and that has a distal end 922 opposite to the pinion 921. A handle 90 is connected to the distal end 922 of the coupling rod 92 for moving the sliding member 40 between the upward and downward positions via the pinion 921 and the rack 912.

The front and rear ends 41, 42 of the sliding member 40 are formed with front and rear mounting holes 411, 421. The first and second shaft-driving gears 60, 70 have first and second toothed heads 61, 71, and first and second annular flanges 62, 72, respectively. The first and second annular flanges 62, 72 rotatably and respectively extend through the first and second mounting holes 411, 421, and are mounted thereto in such a manner that axial movement of the first and second shaft-driving gears 60, 70 are prevented via a pair of C-shaped rings 63, 73 which are sleeved on ends of the first and second annular flanges 62, 72.

The second gear mechanism further includes a second helical gear 88 that engages the first helical gear 84, a coupling shaft 87 connected to and extending from the second helical gear 88 through the left outer wall 31, and a worm gear unit 26 coupled to the coupling shaft 87 and the left screw rod 28 so as to permit sliding movement of the cutter carriage 23 upon rotation of the driving shaft 80. Note that another worm gear unit (not shown) that is associated with the coupling shaft 87 and the right screw rod 28 is not illustrated in the drawings for the sake of brevity.

Figure 3:
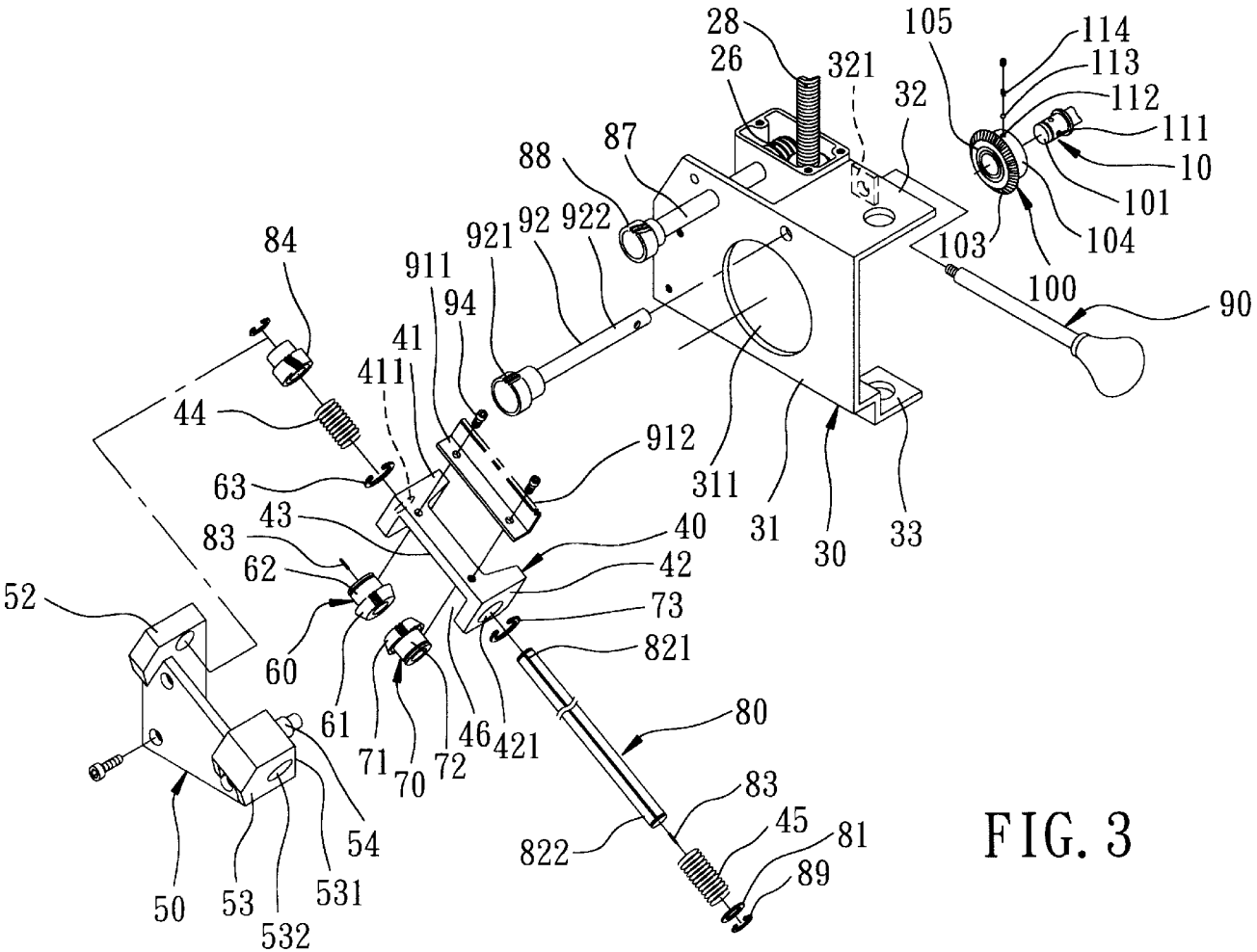
FIG. 3 is an exploded perspective view of the carriage height adjusting unit of FIG. 2.
Figure 4:
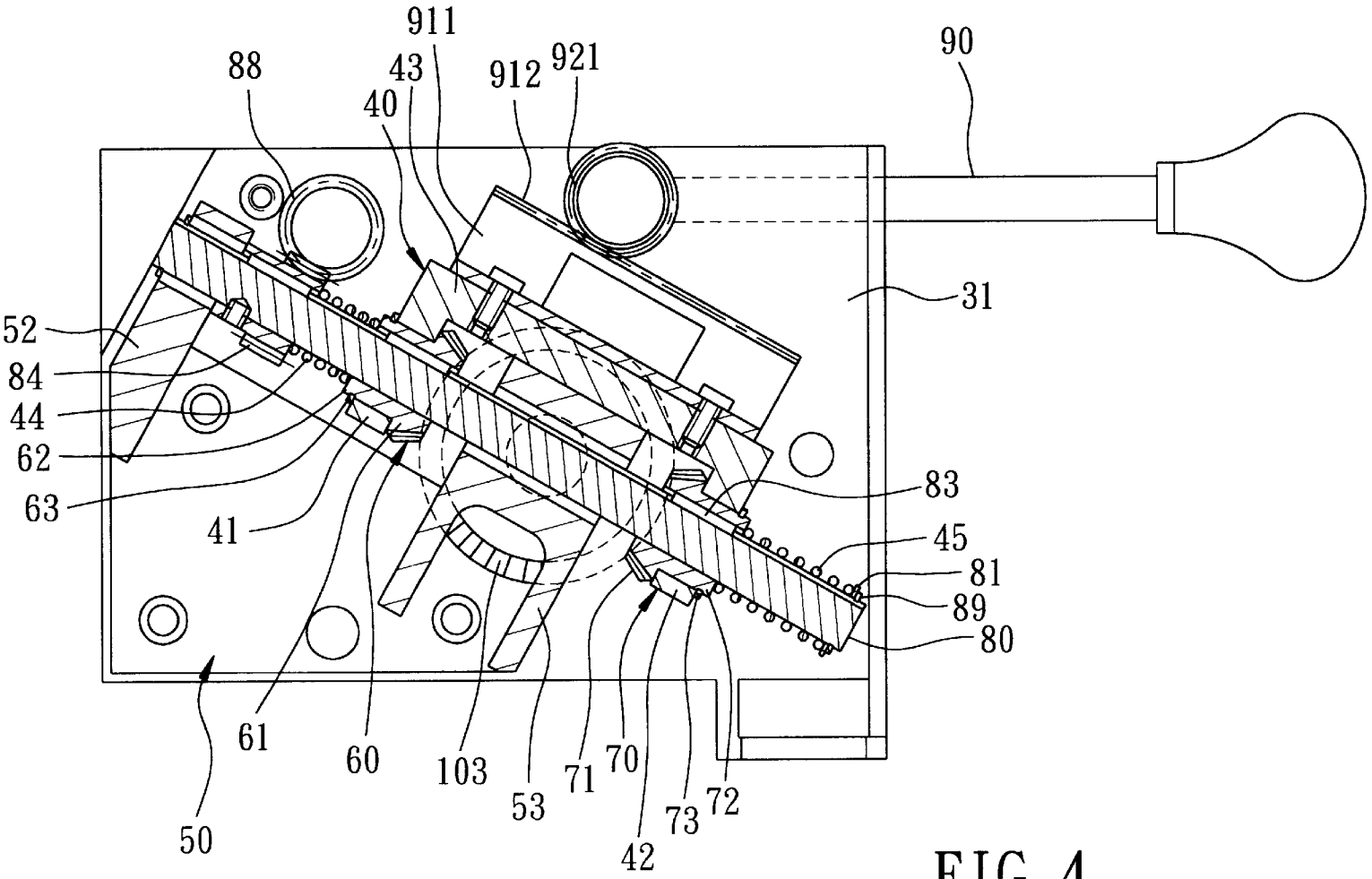
FIGS. 4 and 5 are sectional views illustrating relative positions among a driving gear and first and second shaft-driving gears of the carriage height adjusting unit of FIG. 2 when a sliding member is disposed at a middle position.
Figure 5:
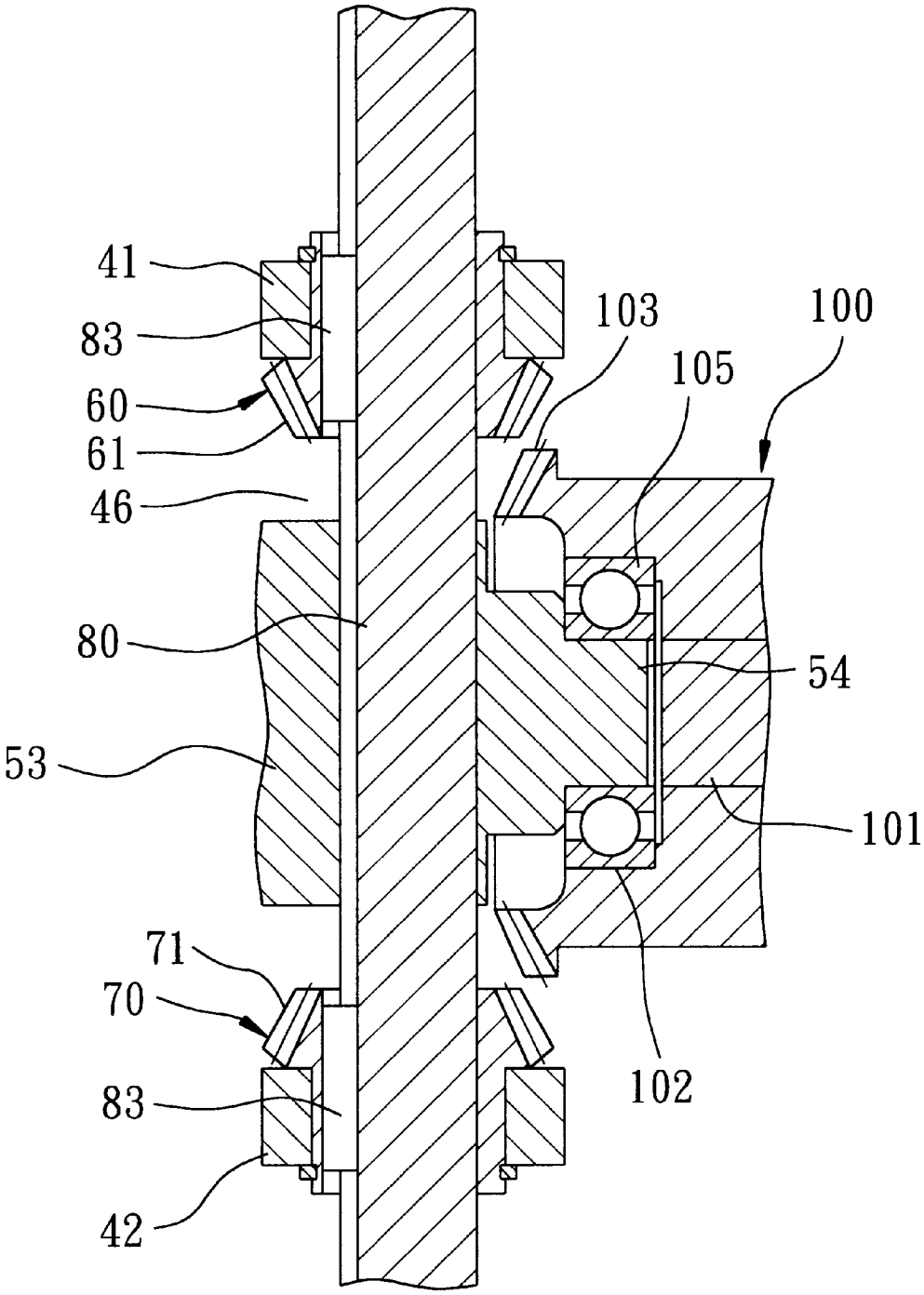
Figure 10:
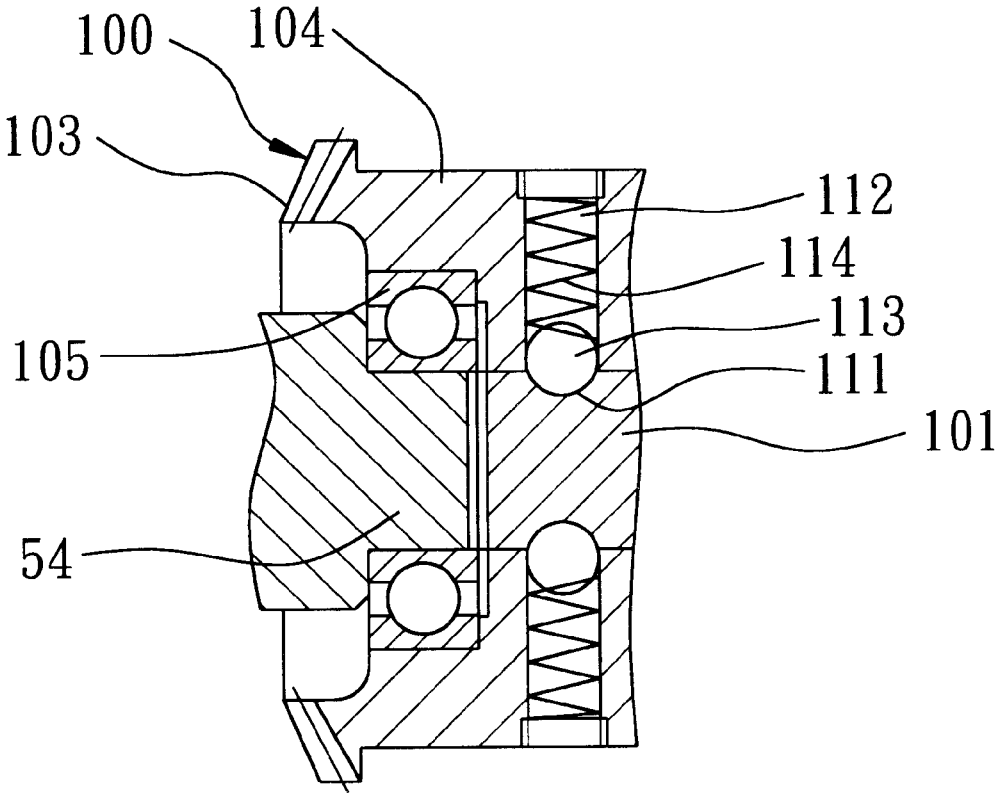
FIGS. 10 and 11 are fragmentary sectional views to illustrate how a retaining unit engages and disengages an output shaft of a motor of the wood planing machine of FIG. 1.
Figure 11:
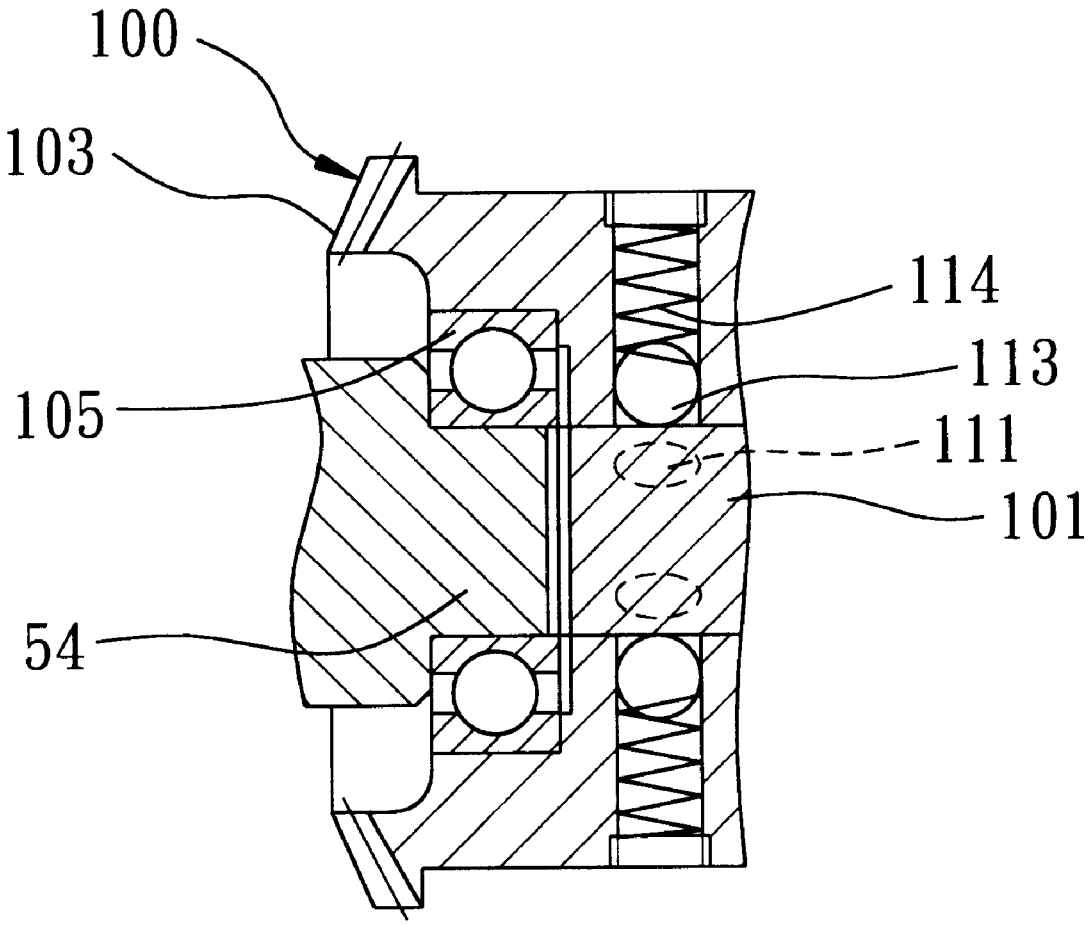

Referring now to FIG. 3, in combination with FIGS. 10 and 11, the output shaft 10 has an engaging end 101 that is formed with a plurality angularly spaced apart retaining holes 111. The driving gear 100 further has an annular flange 104 coaxially projecting from the toothed head 103 and formed with a plurality of channels 112 that are radially aligned with the retaining holes 111, respectively. An engaging ball 113 is movably received in each of the channels 112, and is urged by an urging spring 114 so as to engage a respective one of the retaining holes 111 (see FIG. 10), thereby permitting co-rotation of the output shaft 10 and the driving gear 100. Each engaging ball 113 retracts into the respective channel 112 and disengages from the respective retaining hole ill (see FIG. 11) when sliding movement of the cutter carriage 23 is stopped, thereby permitting idle rotation of the output shaft 10.

Since sliding movement of the cutter carriage 23 is driven by the motor 24 via the carriage height adjusting unit, the aforesaid drawback associated with the prior art can be eliminated. Moreover, with the inclusion of the stud 54 and the bearing 105 in the engagement between the driving gear 100 and a selected one of the first and second shaft-driving gears 60, 70, smooth adjustment of the height of the cutter carriage 23 can be ensured.

With the invention thus explained, it is apparent that various modifications and variations can be made without departing from the spirit of the present invention. It is therefore intended that the invention be limited only as recited in the appended claims.

We claim:

1. A wood planing machine comprising:

a base having left and right sides;

left and right pairs of parallel posts extending upright from said left and right sides of said base, respectively;

left and right screw rods extending upright from said left and right sides of said base between said left and right pairs of said posts, respectively, and parallel to said posts;

a cutter carriage extending among said posts and having left and right mounting seats that are slidably sleeved on said posts and that have left and right outer walls, respectively, said left outer wall being formed with an opening;

a motor mounted on said cutter carriage and having an output shaft that extends outwardly through said opening in said left outer wall;

a bracket secured to said left outer wall; and a carriage height adjusting unit including a driving shaft mounted rotatably on said bracket, a sliding member having opposite front and rear ends that are slidably sleeved on said driving shaft so as to permit sliding movement of said silding member along said driving shaft, opposing first and second shaft-driving gears slidably sleeved on and engaging said driving shaft so as to co-rotate with said driving shaft, and mounted on said front and rear ends of said sliding member, respectively, so as to slide with said sliding member along said driving shaft, a driving gear coaxially and securely connected to said output shaft and disposed between said first and second shaft-driving gears, a first gear mechanism operably coupled to said sliding member in such a manner that operation of said first gear mechanism via an external force applied thereto results in sliding movement of said sliding member together with said first and second shaft-driving gears along said driving shaft from a middle position, in which, said driving gear disengages from said first and second shaft-driving gears, to an upward position, in which, said first shaft-driving gear engages said driving gear so as to permit rotation of said driving shaft in a first direction upon actuation of said motor, and from the middle position to a downward position, in which, said second shaft-driving gear engages said driving gear so as to permit rotation of said driving shaft in a second direction that is opposite to said first direction upon actuation of said motor, and a second gear mechanism coupled to said driving shaft and said left and right screw rods so as to permit upward and downward movements of said cutter carriage along said posts upon rotation of said driving shaft in said first and second directions, respectively.

2. The wood planing machine of claim 1, wherein said front and rear ends of said sliding member cooperately define a gear-receiving space therebetween for receiving said first and second shaft-driving gears and said driving gear, said bracket having opposite front and rear ends, said rear end of said bracket being disposed in said gear-receiving space so as to cover said driving gear.

3. The wood planing machine of claim 2, wherein said driving shaft has opposite front and rear ends that extend through said front ends of said sliding member and said bracket and said rear ends of said sliding member and said bracket, respectively, said second gear mechanism including a helical gear sleeved securely on said driving shaft between said front ends of said sliding member and said bracket, said carriage height adjusting unit further including a restoring unit that includes an annular abutting plate sleeved on said rear end of said driving shaft, a C-shaped ring sleeved on said rear end of said driving shaft and disposed rearwardly of said annular abutting plate to prevent removal of said annular abutting plate from said driving shaft, a first coil spring sleeved around said driving shaft and abutting against said helical gear and said front end of said sliding member, and a second coil spring sleeved around said driving shaft and abutting against said rear end of said sliding member and said annular abutting plate so as to permit restoring of said sliding member from the upward and downward positions to the middle position by virtue of urging action of said first and second coil springs when said first gear mechanism is relieved from the external force.

4. The wood planing machine of claim 3, wherein said driving gear has a toothed head that defines an inner space, said carriage height adjusting unit further including a bearing that is fittingly received in said inner space, said bracket being formed with a stud that projects from said rear end of said bracket and that is received in said bearing so as to enhance stability during rotation of said output shaft.

* * * * *